US011828180B2

(12) United States Patent
Evans et al.

(10) Patent No.: US 11,828,180 B2
(45) Date of Patent: Nov. 28, 2023

(54) PISTON CAM DRIVE

(71) Applicants: Craig Duane Evans, Hightstown, NJ (US); Logan Bryon Hiers-Evans, Hightstown, NJ (US)

(72) Inventors: Craig Duane Evans, Hightstown, NJ (US); Logan Bryon Hiers-Evans, Hightstown, NJ (US)

( * ) Notice: Subject to any disclaimer, the term of this patent is extended or adjusted under 35 U.S.C. 154(b) by 0 days.

(21) Appl. No.: 16/844,374

(22) Filed: Apr. 9, 2020

(65) Prior Publication Data

US 2021/0301661 A1 Sep. 30, 2021

Related U.S. Application Data

(60) Provisional application No. 62/833,061, filed on Apr. 12, 2019.

(51) Int. Cl.

| | |
|---|---|
| ***F02F 1/42*** | (2006.01) |
| ***F01B 9/06*** | (2006.01) |
| ***F04B 9/04*** | (2006.01) |

(52) U.S. Cl.

CPC ..... *F01B 9/06* (2013.01); *F04B 9/042* (2013.01); *F01B 2009/061* (2013.01)

(58) Field of Classification Search

CPC ..... F01B 9/06; F01B 2009/065; F01B 3/04

USPC ..... 123/56.2

See application file for complete search history.

(56) References Cited

U.S. PATENT DOCUMENTS

| | | | | | |
|---|---|---|---|---|---|
| 1,572,068 | A * | 2/1926 | Gould | F02B 75/28 | 123/43 AA |
| 2,966,899 | A * | 1/1961 | Herrmann | F02B 75/26 | 123/56.8 |
| 3,945,358 | A * | 3/1976 | Collins | F02B 75/222 | 123/50 A |
| 4,432,310 | A * | 2/1984 | Waller | B23Q 27/00 | 123/56.8 |
| 5,560,327 | A * | 10/1996 | Brackett | F01B 9/023 | 123/197.1 |
| 6,089,195 | A * | 7/2000 | Lowi, Jr. | F01B 3/045 | 123/53.6 |
| 6,575,125 | B1 * | 6/2003 | Ryan | F01B 3/0005 | 123/56.1 |
| 7,100,549 | B2 * | 9/2006 | Humphries | F01B 9/06 | 123/54.3 |
| 7,503,291 | B2 * | 3/2009 | Gamble | F04B 39/128 | 123/197.3 |
| 9,032,917 | B1 * | 5/2015 | McNitt | F01B 3/0002 | 123/43 R |
| 2005/0172918 | A1 * | 8/2005 | Humphries | F01B 9/06 | 123/56.2 |

(Continued)

*Primary Examiner* — Long T Tran
*Assistant Examiner* — James J Kim

(57) ABSTRACT

The subject of invention is a method to derive specifications for an eccentric cam located in a void within the piston of an IC engine which will have parallel faces abutting the cam. These faces will drive the cam in a rotary fashion and transmit the energy produced by the piston by means of the cams axle. The method employs two variables: (a) the radius of the cam; (b) the degree of its eccentricity. These determine the slope of these abutting faces which will be rotated from the plane that is perpendicular to the axis of reciprocation. This slope is eccentric specific and produce a unique solution in each instance. This slope will be the same regardless of the cams radius. The result is an engine with no lateral oscillations.

3 Claims, 6 Drawing Sheets

(56) References Cited

U.S. PATENT DOCUMENTS

| | | | | |
|---|---|---|---|---|
| 2007/0234898 | A1* | 10/2007 | Boyl-Davis | F01B 3/0085 91/306 |
| 2020/0208619 | A1* | 7/2020 | Komatsu | F04B 1/0408 |

* cited by examiner

Fig. 6A

A:

| | | |
|---|---|---|
| 1 | $r = 4.0000\ cm$ | |
| 2 | $b = 1.3333\ cm$ | |
| 3 | $(((2 \cdot r) - b) \cdot b)^{0.5} = 2.9814$ | $a = 2.9814\ cm$ |
| 4 | $\sqrt{b^2 + a^2} = 3.2660\ cm$ | $c = 3.2660\ cm$ |
| 5 | $\frac{c}{2} = 1.6330\ cm$ | $d = 1.6330\ cm$ |
| 6 | $\sqrt{r^2 - d^2} = 3.6515\ cm$ | $x = 3.6515\ cm$ |
| 7 | $r - x = 0.3485\ cm$ | $e = 0.3485\ cm$ |
| 8 | $\sqrt{d^2 + e^2} = 1.6698\ cm$ | $f = 1.6698\ cm$ |
| 9 | $\tan^{-1}\left(\frac{d}{x}\right) = 24.0948°$ | $m\angle BCA_1 = 24.0948°$ |
| 10 | $\frac{180° - m\angle BCA_1}{2} = 77.9526°$ | $m\angle EBA_1 = 77.9526°$ |
| 11 | $90° - m\angle EBA_1 = 12.0474°$ | $m\angle BA_1E = 12.0474°$ |

Fig. 6B

B:

| | | |
|---|---|---|
| 1 | $r = 4.0000\ cm$ | |
| 2 | $b = 1.3333\ cm$ | |
| 3 | $(((2 \cdot r) - b) \cdot b)^{0.5} = 2.9814$ | $a = 2.9814\ cm$ |
| 4 | $\tan^{-1}\left(\frac{b}{a}\right) = 24.0948°$ | $m\angle AJA_1 = 24.0948°$ |
| 5 | $\frac{m\angle AJA_1}{2} = 12.0474°$ | $m\angle A_3CX = 12.0474°$ |
| 6 | $\left(\frac{\tan^{-1}\left(\frac{b}{(((2 \cdot r) - b) \cdot b)^{0.5}}\right)}{2}\right) = 12.0474°$ | |

PISTON CAM DRIVE

CROSS-REFERENCES TO RELATED APPLICATIONS

This application claims the benefit of the U.S. Provisional Patent Application, Ser. No. 62/833,061, filed 12 Apr. 2019, the contents of which are hereby incorporated by reference herein.

BACKGROUND OF THE INVENTION

1. Field of Invention

The present invention relates to the internal combustion engine.

2. The subject of invention is a method to derive specifications for an eccentric cam located in a void within the piston of an IC engine which will have parallel faces abutting the cam. These faces will drive the cam in a rotary fashion and transmit the energy produced by the piston by means of the cams axle. The method employs two variables: (r) the radius of the cam; (b) the degree of its eccentricity. These determine the slope of these abutting faces which will be rotated from the plane that is perpendicular to the axis of reciprocation. This slope is eccentric specific and produce a unique solution in each instant. This slope will be the same regardless of the cams radius. The result is an engine with no lateral oscillations.

SUMMARY OF THE INVENTION

The double headed piston within a double headed cylinder with an eccentric gear engaged by geared surfaces perpendicular to the action of reciprocation dates to the Aug. 17, 1886 Patent Salmon (US 347/644). The only historical mention was in 1888 concerning the failure of the prototype steam engine which vibrated violently on the tracks. The only improvement over the years was the replacement of the eccentric gear by an eccentric cam and smooth surfaces. It is the claim of this application to have resolved this problem by replacing parallel faces that are perpendicular to the axis of reciprocation by surfaces that are rotated away from that axis. Further, there is a formula that calculates that inclination as a function of the cams eccentricity. Engine drives constructed per the specifications derived by this formula will operate free of losses due to lateral oscillations and will operate at an even velocity.

BRIEF DESCRIPTION OF THE DRAWINGS

FIG. 3 takes the cam depicted in FIG. 1 with the addition of vectors for the purpose of explanation for the derivation of a formula for the improvement of the performance for a double headed piston with an internal eccentric cam located within the piston. The improvement is also applicable to a swing action toroid combustion engine or any variation of pump or engine containing an eccentric circular cam abutted by parallel surfaces.

FIG. 6A takes the mechanism depicted in FIG. 4 and shows a derivation based on the construction shown there in.

FIG. 6B is derived as a mathematical reduction of the former into a single equation. The equation is the formula for the improvement to the internal combustion engine.

FIG. 7 is a plan for a toroid swing action engine and depicts the location of the cam and its model reciprocates 7.3334 cm linearly, the toroid model reciprocates on an arc segment of the same length. The purpose of this figure is to illustrate the void inside the piston, which is identical to the linear construction and how that void needs to be machined.

DETAILED DESCRIPTION OF THE DRAWINGS

Figure 1:
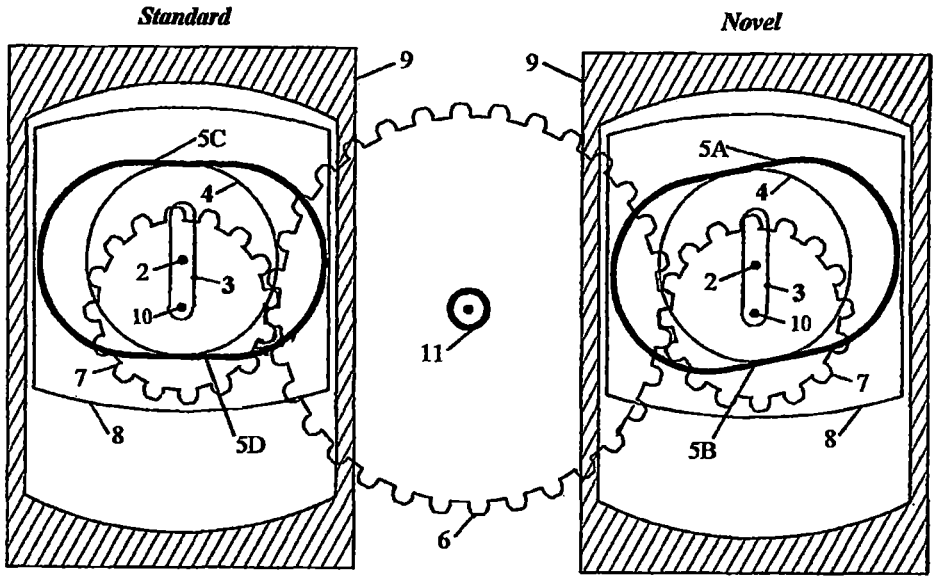
FIG. 1 is a front elevation for a double hemi-faced piston in a liner cylinder with two combustion chambers. Further, it shows the internal cam, its parallel bearing surfaces and the transfer and drive gears. The left construction is the standard design, the right is the novel design. The purpose of this figure is to illustrate the machined area inside the piston, the difference of construction and how that space needs to be machined.

FIG. 1 embodiments such as spark plugs needed for ignition, intake and exhaust ports and piston rings at both sides of 8 are omitted as these peripherals can be provided in a variety of ways and are not the feature that is the subject of this application; shows a side by side comparison of the standard construction, on the left, to the novel construction to the right, the two chambers for either two cycle or four cycle operation are the interior area within 9 that is not occupied by 8. The double hemi-headed cylinder is shown in hash and labeled 9, the double hemi-headed piston is shown in fine line labeled 8. The machined interior area within the piston is shown in heavy line, the upper part is labeled 5A, the lower 5B, these flat portions are the bearing surfaces, the curved ends delineate the minimum clearance required for the cam labeled 4 to rotate and slide along 5A and 5B and can be any shape as they are non bearing, the fine line cam circle is labeled 4, its center labeled 2, the rigidly fasten cam axle is labeled 10. A slot labeled 3 is provided thru both sides of the piston, the length of these slots determined by the length of the piston stroke. The transfer gear is depicted in fine line labeled land are rigidly fasten to the cam axle 10; that axle is rigidly held in place to the engine block by bearings permitting it to rotate freely. A central gear is labeled 6 and is formed around a rigidly attached drive axle labeled 11 allowing for the construction of multi cylindered engine. These are the same for; 2, 3, 4, 5A, 5B 7, 8, and 9, 10 and 11 and are a shared feature. This type of engine operates as follows: force applied from ignition at either end of the piston labeled 8 within 9, is applied to cam 4 by the corresponding parallel faces within the piston; 5A and 5B for the novel model and 5C and 5D for the standard; this forces 4 to rotate which forces the 10 to rotate and the transfer gear labeled 7 to rotate similarly; this allows power to be transferred to the drive train as represented by 6 and 11. This drive train would be used to construct a multi-chambered engine and is here for comparative purposes as either of the models can stand alone as the equivalent of a two cylinder 9 two piston 8 conventional engine. The engine is depicted the point of maximum compression and at a state for ignition, with respect to 2 and the direction of rotation would be determined by the direction of crank polarity and maintained by a fly wheel effect; the novel models direction is determined by the slope of the abutting faces, 5A and 5B as will be illustrated in FIG. 4.

Figure 2:
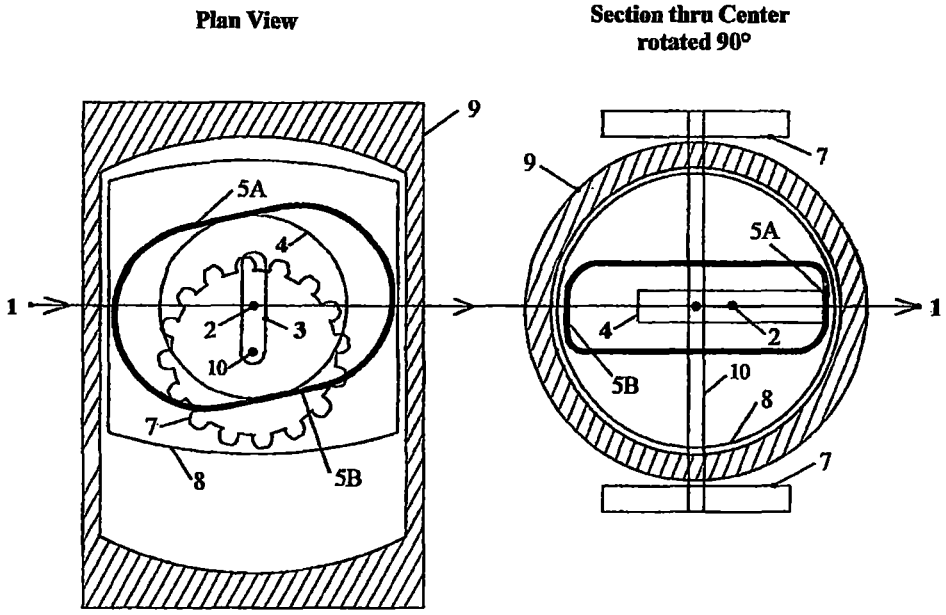
FIG. 2 takes the construction of the novel design from FIG. 1 and shows a section thru center to its right.

FIG. 2 takes the novel construction from FIG. 1, which is a front section thru center and juxtaposes it next to a side section thru center that is rotated 90° along the indicated axis labeled 1. The labeling and lining remain the same, and illustrates: the same labeled embodiments: 2, 4, 7, 8, 9 and 10, the machined faces, 5A and 5B, 3 is omitted, from a second perspective, the functioning of which remain the same. The double headed piston 8 is shown within its double headed cylinder 9 and is in a state of full compression or full exhaust on the side of the piston 8 with the interior bearing face 5A, the lower side 5B is in a state for either compression or exhaust. When ignition occurs in the upper compressed chamber the force exerted on 8 is transmitted to face 5A which in turn is transmitted to 4 causing it to rotate as well as to the rigidly mounted 10 which protrudes through both sides of 8 by means of 3, 10 also protrudes thru 9 but thru a hole of sufficient dimension to accommodate a rigidly mounted bearing to allow 10 to rotate freely. At this point the illustrated engine could be a stand alone, one 8-one 9 engine, could be attached to a gear labeled 7 for the construction of multi cylinder engines or accessories such as an oil pump overhead cams for intake and exhaust ports.

Figure 3:
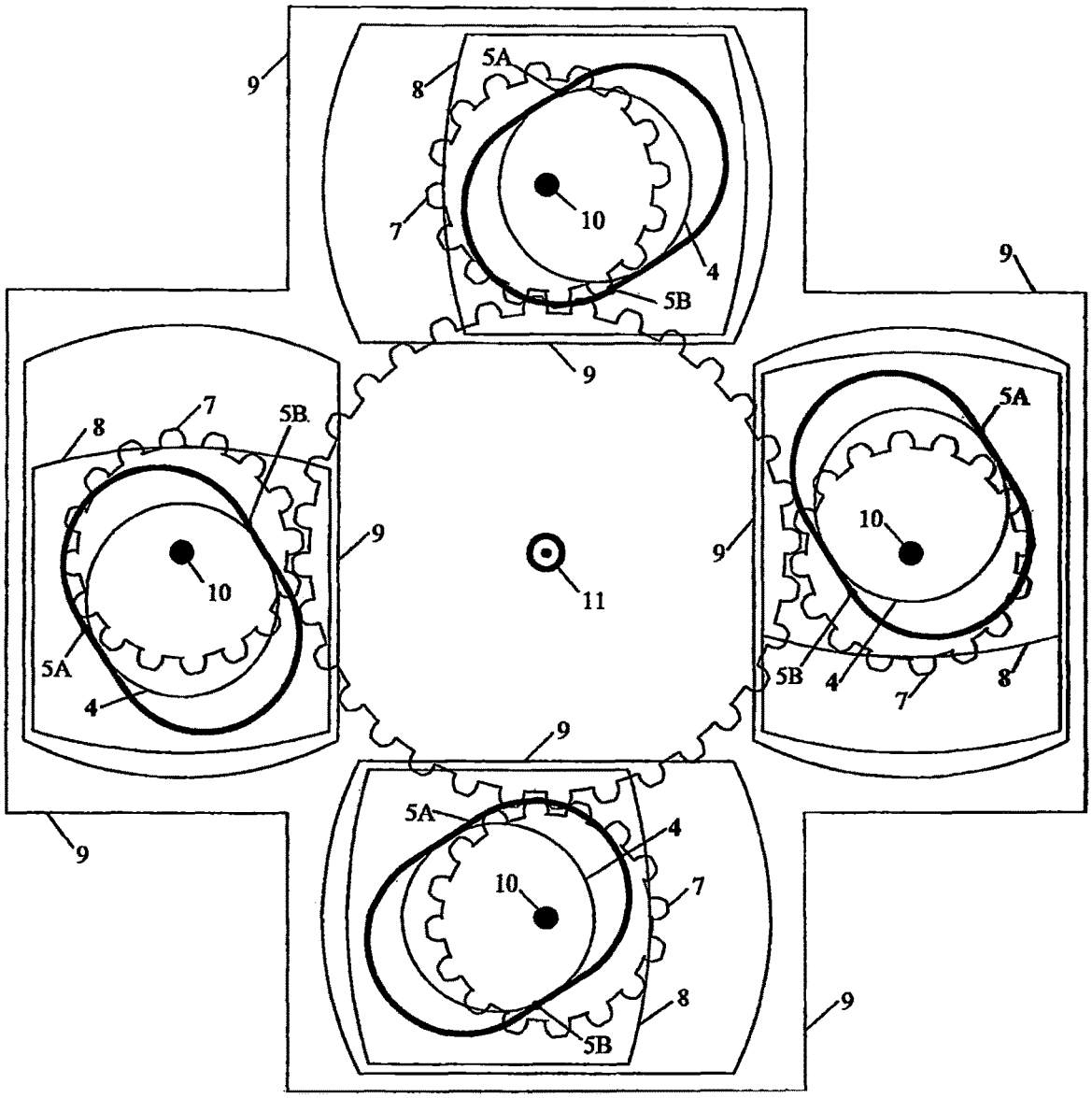
FIG. 3 is a schematic of four such pistons and cylinders in a four block parallel configuration. The same could be used for any variety of radial configurations.

FIG. 3 shows a parallel configuration of four cylinders as configured in FIG. 2. This figure shows four pistons labeled 8 within their cylinders labeled 9. The pistons are double faced as are the cylinder providing two chambers per piston, and are show in fine line. The machined area within the pistons shown in heavy line, 5A and 5B, which would be milled according to the specifications derived by the formula. The cam axles are labeled 10 The drive gear is labeled 6, the cam axle transfer gears are labeled 7 and are drawn in fine line. Four cylinders, 9 at 90° around the Drive shaft provide eight charges/full cycle and are drawn in fine line. Each opposing pair fires simultaneously and 180° apart providing dynamic stability for the engine. The firing order is: 1&3, 2&4, 5&7, 6&8. The cam drive provides linear energy transfer with no losses due to lateral oscillations. These pairs could also be applied to any variety of radial design.

Figure 4:
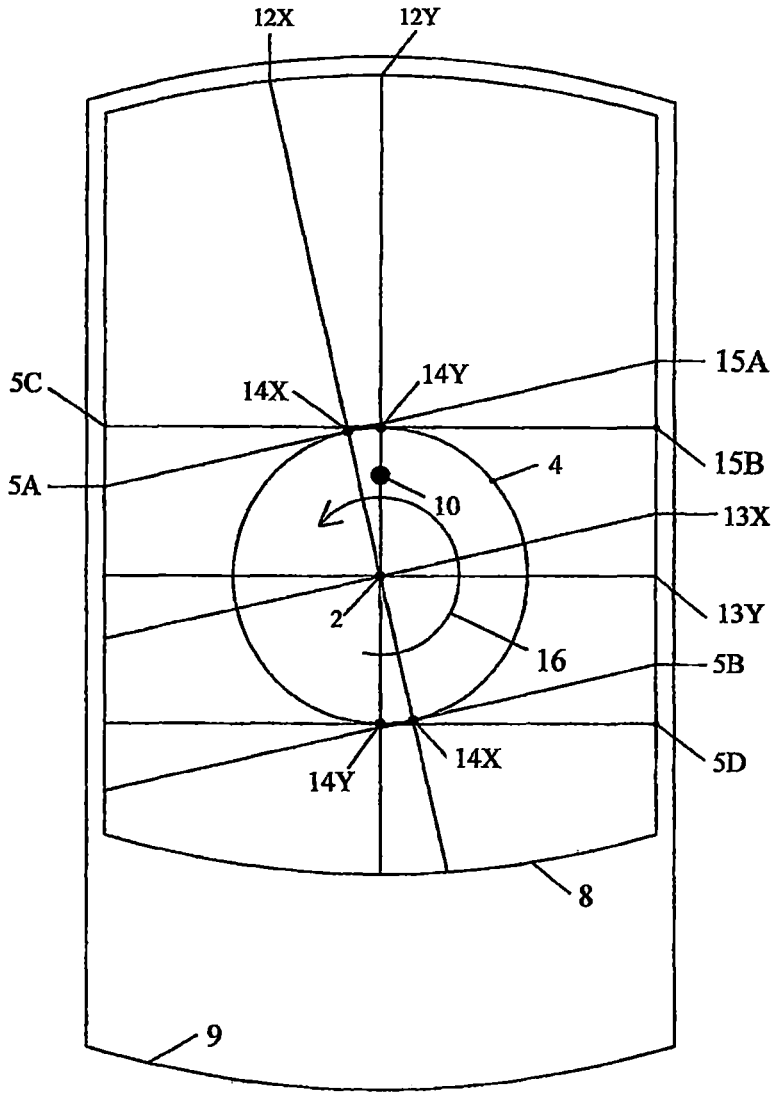
FIG. 4 takes the construction of FIG. 2 and places it in context of the double headed piston labeled 8 within a double faced cylinder labeled 9 with the parallel faces from the standard model 5C and 5B and the novel model 5A and 5B and superimposes them on the cam labeled 4 construction. The purpose is to set the stage for the mathematical proposition which is the subject of FIG. 5.

FIG. 4 Takes the construction of FIG. 2 and are labeled: The piston 8, the cylinder 9, the cam circle 4. The cam center 2 the cam axle 10, with the addition of; a fine line for the axis of reciprocation 12Y, the perpendicular to reciprocation 13Y; the points of contact for the standard model are labeled 14Y and the fine line tangent to these points are labeled 5C and 5D. The novel model is labeled: new axis of force 12X, which no longer is the axis of reciprocation 12Y, the perpendicular to 12X is labeled 13X, the points of contact for the novel construction are labeled 14X, the tangent at these points are labeled 5A and 5B. The slope would be calculated using points 15A and 15B which are the intersection of 5A and 5C with the sides of the cylinder 9. The slope is determined geometrically by dividing the line segments $\overline{15A15B}/\overline{14X15B}$=0.90361/3.75146=0.24087 and the direction of rotation of the cam, 4, would be counter clockwise as shown by the circular arrow labeled 16, if this slope was a negative value the 4 would rotate in a clockwise fashion. The purpose of this Art is intended to define the terms of construction for the geometric construction employed in FIG. 5 and includes the labeling for the construction of the engine to provide context for the derivations for the slope of 5A and 5B for a linear internal combustion engine.

Figure 5:
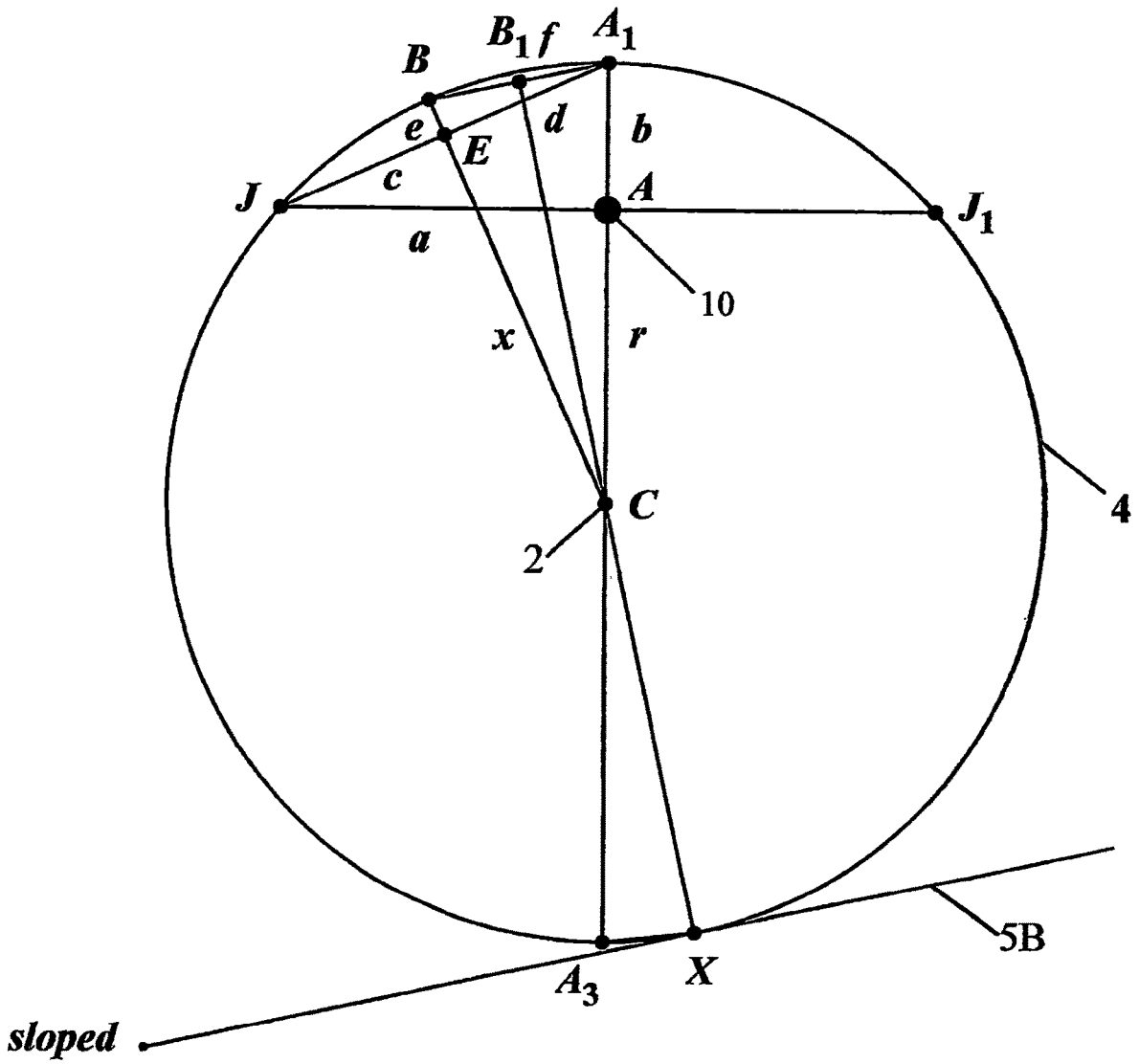
FIG. 5A is derived as a geometric solution by means of theorems.

FIG. 5 takes the cam depicted in FIG. 4 with the addition of vectors for the purpose of explanation for the derivation of a formula for the improvement of the performance for a double headed piston 8, with an internal eccentric cam 4, located within the piston 8 by specifying the machining required for the interior milled area 5A and 5B, as specific to the cams eccentricity. This improvement is also applicable to a swing action toroid combustion engine as illustrated in FIG. 6, the difference being that for the toroidal version reciprocation occurs on an arc segment that is the same length as the line segment upon which the linear model reciprocates, and bears the same construction for the cam 4 and the parallel abutting surfaces, 5A and 5B. The figure includes labeling for the standard geometric construction as applicable for proofs by the theorems used in FIGS. 6A and 6B. The cam circle 4, depicted has a greater degree of eccentricity greater than the cam circle 4 in FIG. 2, for purposes of clarity. In FIG. 5 the eccentricity=b/r=0.3333. The axis of reciprocation is indicated by segment $\overline{A_1A_3}$ which is labeled $\overrightarrow{\mathbf{27\text{-}32}}$ respectively. Segment $\overrightarrow{A_1C}$ labeled $\overrightarrow{\mathbf{27\text{-}2}}$ represents the vector for Centripetal Acceleration which is indicated by the arrow pointing toward the center of Mass, C labeled 2, which is the center of the 4. Segment $\overrightarrow{JJ_1}$ labeled $\overrightarrow{\mathbf{29\text{-}36}}$ is the axis perpendicular to the Axis of reciprocation labeled 12X. Segment $\overrightarrow{JA}$ is the vector for tangential Force directed at Point A. This would normally be constructed at point $A_1$ labeled 27, and would point in the opposite direction but changes direction in accordance with the law of parallelogram of forces. At point X labeled 31, a line segment is constructed named sloped and labeled 5B, represents the tangent to point 31 and is the surface abutting the cam circle at its lower pole 5B. A second point would be constructed by drawing a line thru points 31 and 2 and plotting the intersection of that line and 4, which could be labeled $X_1$, then construct a segment that is tangent to point $X_1$ which would be 5A, but is omitted for purposes of clarity. FIG. 2 shows these surfaces depicted in heavy line, the upper and lower faces, 5A and 5B, and are shown abutting the cam tightly and not as they must need be milled but are strictly for the purpose of illustrating the method for determining the specifications for their milling. The outer and inner surfaces would be formed as semicircles the shape of which would be 4, bisected by a line drawn thru points X and $X_1$. These would be constructed at a point no less than required for the travel of the cam to be unimpeded as it slides up and down the sloped surfaces, further these end caps are non-bearing surfaces and can be of any shape or size beyond that limitation.

FIG. 6A: The hypothesis behind the method is that there is a geometric correlation between the slope of the abutting faces and the degree of eccentricity of the cam which is unique for every degree of eccentricity. Further, that this correlation is a function of the vectors of force exerted on the cam and force transferred by the cam. The eccentricity of the cams yields a novel answer for every degree of eccentricity of the cam because any cam circle will have the same disposition of matter regardless of its physical dimensions. This relates to the physics of rotating objects which, while accelerating have centripetal acceleration that is exerted toward the center of the cam but when spinning at a constant velocity produce tangential force at the point that force is applied to the object. The standard model's performance characteristics are well understood for being incapable of operating at a constant velocity. It is the subject of this application to provide an answer. Conventional linear reciprocating engines transfer power by means of a rod and pin arrangement that is yoked to a crank shaft in order to convert the linear motion of the piston into rotary motion at the crank shaft; the tie rods force the piston to exert lateral force on the cylinder wall in a fashion that resists the direction of that force and the pistons of a multi-cylindered engine are yoked in a fashion that has two pistons cross yoked in a cross balanced fashion, this provides stability and smooth operation, the disadvantage of this arrangement is; for every centimeter of rotation at the crankshaft, x, requires $\pi x$ cm of linear motion of the piston, this referred to as lateral oscillation. In a double headed cylinder 9 with a double headed piston 8 engine, the centrally located eccentric cam's axle 10 is the crankshaft; this arrangement permits transferring the linear motion of the piston on a one to one ratio, there are no lateral oscillations. In the general design for this arrangement the two ends of the piston are cross yoked by the cam 4 and it's axle 10. In the standard arrangement the faces 5C and 5D, all the tangential force is exerted perpendicularly toward one side thru the first half on one rotation of the cam 4 then all the tangential force is exerted to the other side thru the second half of the cams 4 rotation, effectively, there is no balance and the operation of the engine is erratic. FIG. 6A is geometric and in the form of proof by theorems and as such, is in the form of numbered variables and propositions. The eccentricity is not a variable but a given constant for each solution. It starts with the construction of the cam circle and its eccentricity. The two variables are: 1: the radius of the cam called r and labeled 17, which in this instant is 4 cm with respect to the cams center of mass called C and labeled 20; 2: line segment called b and labeled 18, is the distance between point $A_1$ labeled 27 and point A labeled 10 which is 1.3333 cm, which represents centripetal acceleration at the point A labeled 10. 3: The eccentricity is 18/17=b/r=0.3333. 4: Next, a line that is perpendicular to the axis of reciprocation, which is represented as a line segment between points $A_1$ and $A_3$, would be drawn thru the center of the cam axle A labeled 10, and plot the points of intersection with the 4 which are points J labeled 29 and $J_1$ labeled 30. This will form two equal chords $\overline{JA}$ and $\overline{AJ_1}$. We will designate chord $\overline{JA}$ as the second vector a labeled 19, we can calculate the relative magnitude of vector a which is labeled 19 using the intersecting cord theorem, $(((2*r*b)-b))*b)^{0.5}$, which gives us a value of a=2.9814 cm 5: We can now calculate the magnitude of vector c which is labeled 20 by taking $(a^2+b^2)^{0.5}=c$ which results in the relative value of the vector c=3.2660 cm which is referenced as 20. 6: Next, bisect vector 20, which gives us a value for vector 21, which is d=c/2 which results in a relative value of d=1.6330 cm. The point of bisection forms point E labeled 28, then construct a line segment between points 2 and 28 which forms x labeled 22. 7: We now solve for segment 27 which is x, $(r^2-d^2)^{0.5}=x$ which has a relative value of x=3.6515 cm. 8: We construct a line thru points 2 and 28 and plot its intersection with the upper half of the 4 which is designated point B and labeled 25, then we construct a line segment between points 25 and 28 which we designate as e labeled 23. We solve for e, r−x=e, which has a relative value of e=0.3485 cm. 9: Then construct a line segment between points 25 and 27 which will be designated f and labeled 24 by the equation, $(a^2+b^2)^{0.5}=f$, which results in a relative value of f=1.6698 cm, which will form the base of an isosceles triangle from points B-C-$A_1$ (25-2-27) as points 25 and 27 are on the cam circle and are equidistant from 2 by a factor of r labeled 17. 10: We now solve for the measure of angle B-C-$A_1$ (25-2-27) whose value is needed to solve for the angle of inclination which is calculated by the formula, $\tan^{-1}(d/x)=24.0908°$. 11: Now we can calculate the measure of angle E-B-$A_1$ (28-25-27) which is (180°−angle B-C-$A_1$)/2=77.9526°. 11: Finally, we solve for the measure of angle B-$A_1$-E (25-27-28) which is the degree that the x axis will be declined, which equals (90°−angle B-$A_1$-E)= 12.0474°.

FIG. 6B: The second derivation uses the same construction as FIG. 6A with the same given, and variables, 1: r=4 cm, which is the distance between points A and $A_1$ 2: b=1.3333 cm, which is the distance between points, 3: eccentricity=b/r=0.3333, 4: solves for a but reduces it to a trigonometric equation by the process of reduction using the intersecting chords theorem we solve for a using r and b with, $b(((2*r*b)-b))*b)^{0.5}$, which gives us a value of a=2.9814 cm., 5: We solve for the measure of angle B-C-$A_1$ (25-2-27) the value needed to solve for the angle of inclination as calculated by the formula, $\tan^{-1}(d/x)=24.0908°$, 6: this angle is then bisected giving us the degree of rotation from the perpendicular to the axis of reciprocation which would be, $(\tan^{-1} b/a)/2=12.0748°$, 7: finally; the entire process is reduced to a single equation using variables r and b, $$\tan^{-1}\left(b/\left(\frac{((2r)-}{b}\right)b\right)/2\right)^{.5}.$$

The sloped faces are formed by rotating the polar axis by the calculated degree of rotation then constructing a perpendicular to that axis at the poles, the radius of the cam is used to describe the size of the throw for the piston, the slope of the tightly abutting faces to that cam which in turn translate the force applied at either end of a double faced piston within a double faced cylinder to that cam to translate that force into continuous circular motion to its rigidly attached axle by which that circular motion can be translated thru the sides of the piston and its cylinder by means of a rigidly mounted bearing attached to the exterior walls of the cylinder block in a fashion that permits the axle to freely rotate, would be unique to any such arrangement with the same ratio of b/r.

Figure 7:
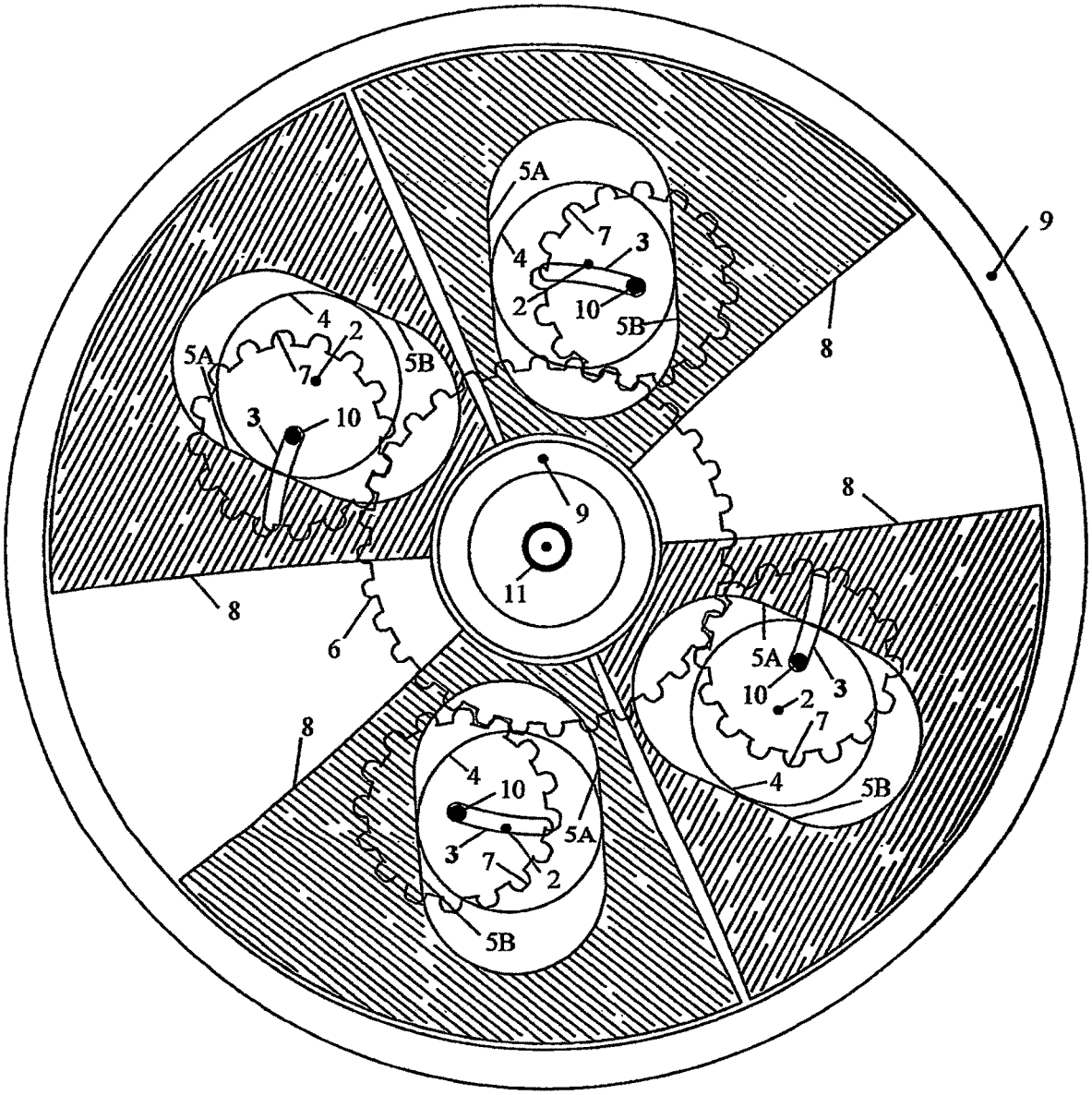
FIG. 7 is a plan for a toroid swing action engine and depicts the location of the cam and its abutting surfaces. These aspects are identical for both types of engines, the only difference being, the linear model reciprocates 7.3334 cm linearly, the toroid model reciprocates on an arc segment of the same length. The purpose of this figure is to illustrate the void inside the piston, which is identical to the linear construction and how that void needs to be machined.

FIG. 7 shows the basic configuration for an opposed swing action cylinder reciprocating toroidal engine. As in FIG. 2 features such as spark plugs intake and exhaust ports and piston rings are not indicated as these are necessary for an explanation for how transmits force from ignition is transmitted to the piston, to the faces to the cam and its axle. As in the linear design: the radius of the cam; the degree of eccentricity; the distance between the center of the drive's axle and center of the cam axle; and displacement are the same. The design is shown in plan: The FIG. illustrates: the four pistons labeled 8 in hash within their fine line perimeters; the walls of the single toroidal cylinder labeled 9, indicating the space between the four fine line concentric circles that form the interior and exterior perimeter of 9; the central axle is labeled 11 and is the point around which the cylinder walls are concentric; the four fine line circular cams labeled 4; within each piston, with each piston's interior milled area drawn in fine line and labeled 5A and 5B per each piston 8; Point 10 denotes the four cam axles. The drive gear 6, and the four transfer gears 7, are dawn in fine line. The shaft slots 3, formed in the piston walls in fine line surrounding the cam axles 10, these slots 3, also serve as ports through which oil is circulated into the cylinder and thru the pistons, lubricating the toroid walls. The cam 4, is 33.3334% eccentric. The pistons 8, each occupy 64 degrees of the toroid. The cams 4, are 68 degrees apart and are locked in a stationary position to the cylinder 9 wall. Charge is pumped into the space between the pistons during the period from full discharge to full expansion ending with the start of compression. The order of charge cycle is: 1-2-3-4.

We claim:

1. An internal combustion (IC) engine: comprising at least one pair of aligned and opposed cylinders; forming a double headed cylinder; has a reciprocating double headed piston in each cylinder pair comprised of a closed-end cylinder with conventional type piston hems on both ends of the cylinder and a milled space within to accommodate a means for transmitting the linear motion of the piston into circular motion at a drive shaft comprised of: an eccentric cam circle rigidly attached to a drive shaft that is perpendicular to the axis of reciprocation and at the center of the double-headed cylinder; the cam will engage the surfaces of a slot milled at the center of the piston with parallel faces; the upper and lower surfaces would be flat and separated by at least the diameter of the cam circle, and milled at an angle to the perpendicular to the axis of reciprocation and of a length nominally greater than the measure of the length of the piston's reciprocation, the outer surfaces would be half circles with a diameter equal to the measure of the distance between the upper and lower surface forming an ovate milled space, which in previous art would be milled in parallel to the piston head; which the premise of this application is, that the eccentricity of the cam determines the slope of the interior machined slot, for surfaces in tight contact with the cam at both sides of the cam in a parallel fashion: the purpose is to remedy the known imbalance of velocity that occurs between the two ends of the piston on ignition.

2. A method for determining the specifications of the slope of the tightly fitting faces machined from the interior of the piston will be derived by a geometric construction of vectors of force to derive the milling of the novel slope for the faces abutting an eccentric cam; which the premise of this application is, that the eccentricity of the cam determines the slope of the interior machined plane for surfaces in tight contact with the cam at both sides of the cam in a parallel fashion, which is different than a plane drawn thru the center of the cam that is perpendicular to the inner sides of the piston for the purpose of balancing the force exerted by ignition to the piston's heads which will be transmitted to a cam centrally located within the cam by the tightly fitting parallel faces that have been milled within the pistons interior which will transmit this force to the cam at the points of contact at both sides of the cam causing the cam to rotate, so that the torque produced at the cam may be transmitted in a continuous circular fashion by means of its rigidly attached axel to an external device in a fashion permitting it to run at a constant velocity, both as a stand-alone engine or to another gear for the purpose of constructing multi-cylinder engines of such configurations as radial or parallel for a balanced application of force applied to:

a determination of the degree of eccentricity determines the slope of the abutting faces to the cam within the piston, which is the single embodiment of this application, a method employing a sequence for constructing a geometric figure using cartesian coordinates for the specifications for the milling of this interior space would be as follows:

an origin point that is the point formed by the intersection of the x and y axis which will be the point and would have a value 0:0, this axis point represents the point center of the eccentric circular cam;

a point is selected along the y axis which will be the point around which the eccentric cam circle will be scribed;

a point will be selected between the origin point and the selected point on the y axis used to determine the radius of the eccentric cam circle which will also represent the cam's axel and will have a value greater than zero, and at least greater than the diameter of said axle, and lessor than by that same diameter which is the vector of centripetal acceleration as it applies to the cam's axel;

a point will be selected between the origin point and the selected point on they axis used to determine the radius of the eccentric cam circle which will also represents the cam's axel and will have a value greater than zero, and at least greater than the diameter of said axle, and lessor than by that same diameter which is the vector of centripetal acceleration as it applies to the cam's axel;

a measure of the distance between the origin point and the selected point on they axis represents the radius of the eccentric cam circle;

a line segment will be scribed between the origin point which represents the cam's axel and the selected point on the y axis used to determine the radius of the eccentric cam circle which is the vector of centripetal acceleration as it applies to the cam's axel;

a perpendicular line to the line segment derived for the radius of the cam circle divided by the measure of centripetal acceleration and that the half on the right side of the y axis is scribed thru the point representing the center of the cam's axle and the intersection of this line with the eccentric cam's circle forms the line segment, the point center of the cam's axle is the bisection of this line segment and forms two equal segments, one would have a positive value the other a negative value, either represents the vector for tangential force as applied to the cam's axle, we will assume that that the half is negative and on the left side of the y axis and that the cam would rotates in a counter clockwise fashion, and that if positive and on the right side the cam would rotate in a clockwise fashion;

a line segment would be scribed between the point of intersection with the eccentric cam circle on the left by side of the y axis and the eccentric cam circle and the point selected along the y axis used to determine the eccentric cam circle the measure of which is the cumulative vector for force at the cams axle which is the same as the force exerted at the eccentric cam's center;

a line segment for the cumulative vector for force at the eccentric cam's axle, would then be bisected by a point forming two equal segments the, measure of the segment to the right which would be the tangential force applied to the upper side of the eccentric cam circle while the other portion of the total force is applied to the lower side;

a line is scribed thru the point of bisection of tangential force to the cam's axle and the point center of the cam then plot the intersection of that line with the cam circle, the line segment drawn between this point and the point of bisection of tangential force to the cam's axle would be the vector for centripetal acceleration at the upper half as applied to the cam's center;

a segment between the points for the vector for centripetal acceleration at the upper half as applied to the cam's center and the selected point on the y axis used to determine the radius of the cam is scribed which forms the cumulative vector for force at the upper half of the cam which would be the cumulative vector tangential force as applied to the cam's axle; the segment for the vector for tangential force as applied to the cam's axle is bisected then scribe a perpendicular line thru this point and plot the intersection of that line with the cam circle which are the point of contact for the parallel faces abutting the cam; a line segment for the cumulative vector for force at the eccentric cam's axle, would then be bisected by a point forming two equal segments the measure of the segment to the right which would the tangential force applied to the upper side of the eccentric cam circle while the other portion of the total force is applied to the lower side;

a tangent to the points of contact for the parallel faces abutting the eccentric cam circle will form the plane along the z axis upon which the opposing faces will be formed; a surface milled from the interior of the piston at the points of contact for the parallel faces abutting the eccentric cam circle of contact for the parallel faces abutting the eccentric cam circle form the tightly fitting interior surfaces that upon ignition at either side of the cam will force the cam to rotate in a continuous circular fashion in a symmetric fashion capable of maintaining a constant velocity.

3. A reciprocating four-cylinder engine block four piston toroidal internal combustion engine based on a method as outlined in claim 2; as such:

the axis of reciprocation, would be along a circle centered at the center from which the toroid contours will be scribed and the center of each of the four cams and their axle, and would be the same for each piston, the length of reciprocation, would be the same for each piston;

an engine block will be milled with two opposing sides milled flat, the entirety of this block will be milled along the circular axis of reciprocation, a point centrally located on the engine block, which will be of a given radius and will form the outer exterior dimension of the engine block and a second will have a smaller radius and will form the interior dimension between the inner and outer radius which is the axis of reciprocation, and a groove would be milled along this circle which would have a maximum depth of ¼ of the value of the distance between the inner and outer radius, and would be the contours of the four double faced cylinders contained within the engine block: partitions would need to be provided to separate the toroid's interior of which for a four chambered engine they would be formed by milling along this circle which would have a maximum depth of ¼ of the value of the distance between the inner and outer radius, and would be the contours of the four double faced cylinders contained within the engine block: partitions would need to be provided to separate the toroid's interior of which for a four chambered engine they would be formed by using a cord from the center of the toroid to the outer wall of the toroid's interior and determining the intersection with the inner and outer contours of the toroid, so they would use a cord from the center of the toroid to the outer wall of the toroid's interior and determining the intersection with the inner and outer contours of the toroid, so they would be pie shaped wedges and would occupy four times that portion of the toroid's interior they occupy the remainder would be the contours of the cylinders each occupy ¼, an identical block would form the other side differing in the arrangement for intake, exhaust and oil ports and spark plugs and when assembled comprises the toroidal engine block;

a piston body sides would be circular in shape to conform to the counters of the toroid's interior with the piston's heads surfaces forming a truncated triangle, these would be done using the same cord used in determining the faces of the cylinders, the remainder of the cylinders interior space would form eight chambers for compression and ignition each cylinder would have two chambers, the pistons can be no greater than ½ the area of the cylinder and by an amount determined for a desired compression;

a machined interior area within the piston milled to tightly abut the cam, these are in parallel fashion at the opposing sides of the cam in a fashion that rigidly attaches the opposing sides of the piston by means of that portion of the entire piston that has not been machined to accommodate the interior bearing surfaces and at a slope that is greater then a plane bisecting the piston thru the center of the cam's axle that is perpendicular to the inside surface of the cylinder, the axis of reciprocation would be a circle drawn thru the center of the cam's axle with respect to the center point of the toroid that is perpendicular to this plane, such that when ignition occurs at either end of the piston force is applied to the piston head, then to the cam by means of the machined surfaces to the opposing sides of the cam forcing it to rotate in a direction determined by that slope, these determined using cartesian coordinates, if the slope is positive the direction of rotation would be counter clockwise, if the slope is a negative value the rotation would be clockwise as these machined faces are pitched to leverage the cam, this in turn transmits the force applied to the pistons heads from ignition, to the tightly fitting machined interior surfaces, to the cam at both sides, then to the cam's axle which will protrude thru the piston and its cylinder wall on at least one side, and shall be of a radius no less then the radius of the cam axle and than the length of the arc segment of reciprocation, but preferrably both sides and this axle will have a gear rigidly attached to the cam's axle: as there are four pistons within the engine block each piston's cam's axle shall have an identical gear of the same radius that will be on the same plane as the others, to be used as the means of transmitting circular motion directly to a transfer gear that is exterior to the cylinder's casing so that the pistons contained within the cylinder will be harnessed together to a drive axle located at, which shall have a gear rigidly attached to the drive axle, that is on the same plane as the four transfer gears and of a radius sufficient to engage each of the four cam's transfer gear, this drive gear will lock the four pistons within the engine block in a fashion that insures each piston reciprocates at the determined arc segment of it's reciprocation such that when ignitions occurs in the chamber between the opposing faces of these pistons, of which there will be four, the force of ignition will be transmitted to the interior milled faces, to the cam within each piston, to the cam's axle, to the cam's transfer gear, to the drive gear, to the drive axle, then to other devices;

a force is exerted from ignition to the piston's heads, that force will be exerted at these poles by the parallel abutting surfaces to the cam causing it to rotate in a direction of rotation determined by the slope of these faces, in turn forcing the cams rigidly attached axle to rotate, by means of which the force from ignition may be conveyed to another device: the formula allows for the calculation for the machining of opposing parallel faces in the interior of a piston that tightly abut an centrally located eccentric cam within the piston, based on the eccentricity of the cam, to be used as an engine, or conversely, as a pump where it is desirable for an engine, pump or compressor capable of running at a constant velocity: this application is further applicable to other toroidal internal combustion engine configurations such as an opposed piston swing action toroidal internal combustion engine.

* * * * *